US007200971B2

(12) United States Patent
Klein et al.

(10) Patent No.: US 7,200,971 B2
(45) Date of Patent: Apr. 10, 2007

(54) SUSPENDER BOTTOM BRACKET FOR CEILING FRAMEWORKS, A SUSPENDER HAVING THIS KIND OF BOTTOM BRACKET, AND AN ASSEMBLY COMPRISING A SEALING FRAMEWORK AND AT LEAST ONE SUCH SUSPENDER

(75) Inventors: Jean-Pierre Klein, Clamart (FR); Andre Rivaud, Vaires-sur-Marne (FR); Pascal Ozouf, Champs sur Marne (FR)

(73) Assignee: Placoplatre, Suresnes (FR)

( * ) Notice: Subject to any disclaimer, the term of this patent is extended or adjusted under 35 U.S.C. 154(b) by 524 days.

(21) Appl. No.: 10/265,656

(22) Filed: Oct. 8, 2002

(65) Prior Publication Data

US 2003/0066261 A1 Apr. 10, 2003

(30) Foreign Application Priority Data

Oct. 8, 2001 (FR) ..... 01 12919

(51) Int. Cl.
*E04B 9/18* (2006.01)
*E04B 9/20* (2006.01)

(52) U.S. Cl. ..... 52/506.05; 52/506.06; 52/712; 248/612

(58) Field of Classification Search ..... 52/506.05, 52/506.06, 702, 712, 713, 698; 248/612 X, 248/613, 73
See application file for complete search history.

(56) References Cited

U.S. PATENT DOCUMENTS 828,488 A * 8/1906 Lanz ..... 29/897.3
1,146,251 A * 7/1915 Harp ..... 52/715
1,936,389 A * 11/1933 Hallquist ..... 267/140.4
1,956,108 A * 4/1934 Symington ..... 267/140.2
2,044,649 A * 6/1936 Swennes ..... 267/140.4
2,744,718 A * 5/1956 Markowski ..... 267/151
3,721,417 A * 3/1973 Skala ..... 267/151
4,560,301 A * 12/1985 Gilb ..... 403/232.1
5,236,273 A * 8/1993 Gilb ..... 403/232.1
5,603,580 A * 2/1997 Leek et al. ..... 403/232.1
5,653,079 A * 8/1997 Loeffler et al. ..... 52/712
6,295,780 B1 * 10/2001 Thompson ..... 52/712
6,572,087 B2 * 6/2003 Schleinitz ..... 267/152

FOREIGN PATENT DOCUMENTS

| | | |
|---|---|---|
| FR | 2 800 771 | 10/2001 |
| GB | 630311 | 10/1949 |
| GB | 2 126 307 | 3/1984 |
| GB | 2 199 349 | 7/1988 |

* cited by examiner

*Primary Examiner*—Tamara L. Graysay
(74) *Attorney, Agent, or Firm*—Young & Thompson

(57) ABSTRACT

A suspender bottom bracket for ceiling frameworks, includes a support wall that is adapted to be fastened to a rod of the suspender and is extended by two flanges in parallel planes that each have a rim parallel to the support wall, the two rims being directed toward the interior of the volume encompassed by the support wall and the planes of the flanges. The rims have at their end a fixing lug, the fixing lugs being on the opposite side of the support wall relative to the rims, perpendicular to the support wall, and are offset in a direction parallel to the planes of the flanges by a distance sufficient to provide a passage for the framework. The flanges that extend from the support wall as far as the rims have the overall shape of parallelograms.

18 Claims, 2 Drawing Sheets

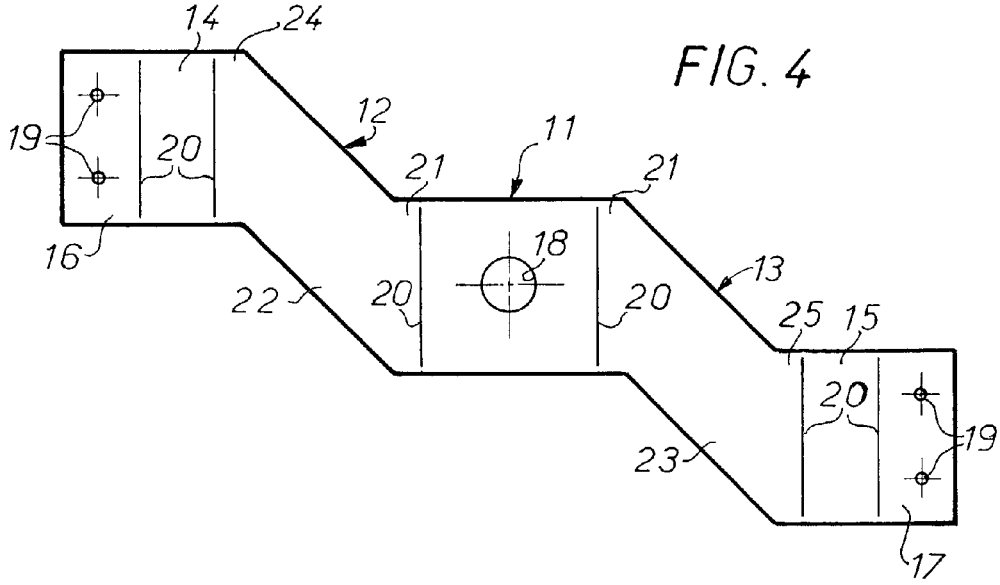
FIG. 4
FIG. 5
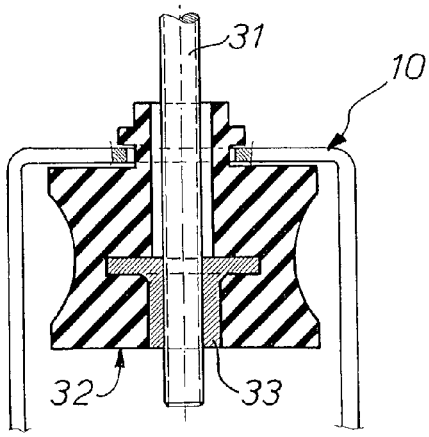
FIG. 6
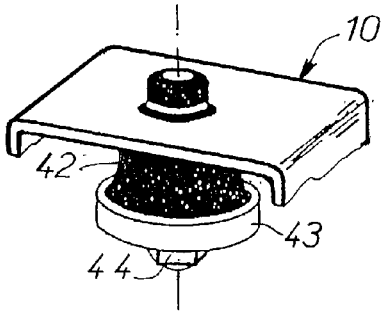
FIG. 7
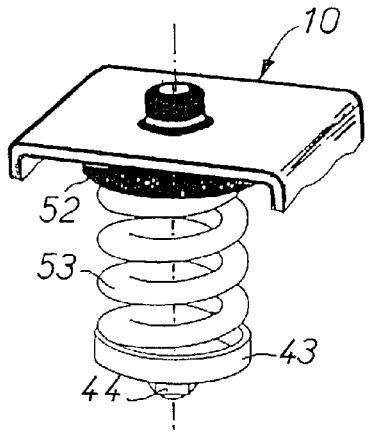

SUSPENDER BOTTOM BRACKET FOR CEILING FRAMEWORKS, A SUSPENDER HAVING THIS KIND OF BOTTOM BRACKET, AND AN ASSEMBLY COMPRISING A SEALING FRAMEWORK AND AT LEAST ONE SUCH SUSPENDER

BACKGROUND OF THE INVENTION

The invention relates generally to suspenders used to suspend sections from a support, for example to hold up a framework consisting of rows of sections receiving a suspended ceiling.

A suspender generally includes a rod coupled to a bottom bracket; the end of the rod that is not coupled to the bottom bracket usually has a head adapted to be attached to the support, and the bottom bracket is adapted to receive the section to be suspended.

If it is required to adjust the height of the bottom bracket relative to the head, the rod is a threaded rod which is screwed into the head and onto which the bottom bracket is screwed.

The suspender bottom bracket comprises a support wall adapted to be fastened to said rod, the support wall being extended by two flanges in parallel planes and on the same side of the support wall; the two flanges each have a rim parallel to the support wall, the two rims being directed toward the interior of the volume encompassed by the support wall and the planes of the flanges; the two rims, which are directed toward each other and aligned with each other, define an open ring adapted to have the upper portion of the T-shaped sections of the framework threaded through it.

Obviously, they can only be threaded through in this way before the suspenders are installed, i.e. before the heads of the suspenders are fixed to the support.

Clearly, the presence of the sections does not facilitate installing the suspenders; what is more, nowadays it is preferred to install the suspenders, to adjust them if they are adjustable, and then to fit the sections.

An object of the present invention is to propose a suspender bottom bracket enabling this.

SUMMARY OF THE INVENTION

According to the invention, a suspender bottom bracket for ceiling frameworks, which bottom bracket comprises a support wall which is adapted to be fastened to a rod of the suspender and is extended by two flanges in parallel planes and each having a rim parallel to the support wall, the two rims being directed toward the interior of the volume encompassed by the support wall and the planes of the flanges, is characterized in that the rims have at their end a fixing lug, said fixing lugs being on the opposite side of the support wall relative to the rims, perpendicularly to the support wall, and being offset in a direction parallel to the planes of the flanges by a distance sufficient to provide a passage for the framework, said flanges that extend from the support wall as far as said rims having the overall shape of parallelograms.

It is advantageous if the support wall is generally rectangular and the area connecting the flanges to the support wall extends the support wall, said connecting area being extended into said parallelogram shape.

It is preferable if the rims are generally rectangular and the area connecting the flanges to said rims extends the rims, said connecting area extending into said parallelogram shape.

The non-parallel sides of the parallelograms are advantageously at an angle of 45° to each other.

The present invention also provides a ceiling framework suspender including a rod coupled to the above bottom bracket.

The rod is advantageously a threaded rod.

The rod is preferably coupled to the bottom bracket by an elastic member.

The elastic member is advantageously an elastomer block.

Alternatively, the spring member is a coil spring.

The spring member advantageously comprises an elastomer block and a coil spring in series.

The present invention also provides an assembly comprising a ceiling framework and at least one of the above suspenders.

It is advantageous if the framework comprises I-sections and the fixing lugs of the bottom brackets are fastened, for example screwed, to the web of said sections.

BRIEF DESCRIPTION OF THE DRAWINGS

To explain the invention better, an embodiment shown in the accompanying drawings is described next by way of purely illustrative and non-limiting example.

In the drawings:

FIG. 4 is a plan view showing a cut-out blank which is bent to obtain the bottom bracket from FIGS. 1 to 3;

FIG. 5 is a partial view in section of a suspender including the bottom bracket from FIGS. 1 to 3;

FIG. 6 is a partial perspective view of a variant of the suspender including the bottom bracket from FIGS. 1 to 3;

FIG. 7 is a partial perspective view of another variant of the suspender including the bottom bracket from FIGS. 1 to 3.

DESCRIPTION OF THE PREFERRED EMBODIMENTS

Figure 1:
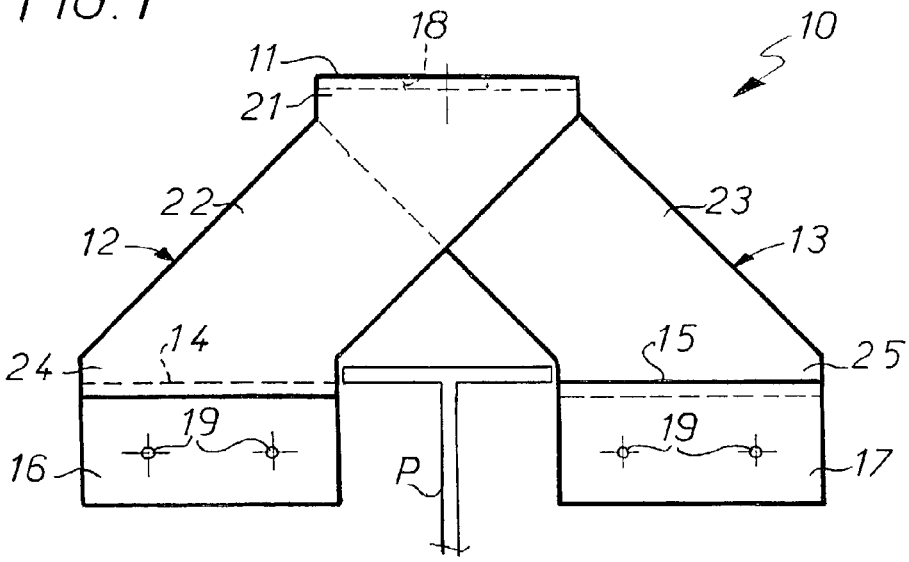
FIG. 1 is an elevation view of a suspender bottom bracket according to the invention.
Figure 2:
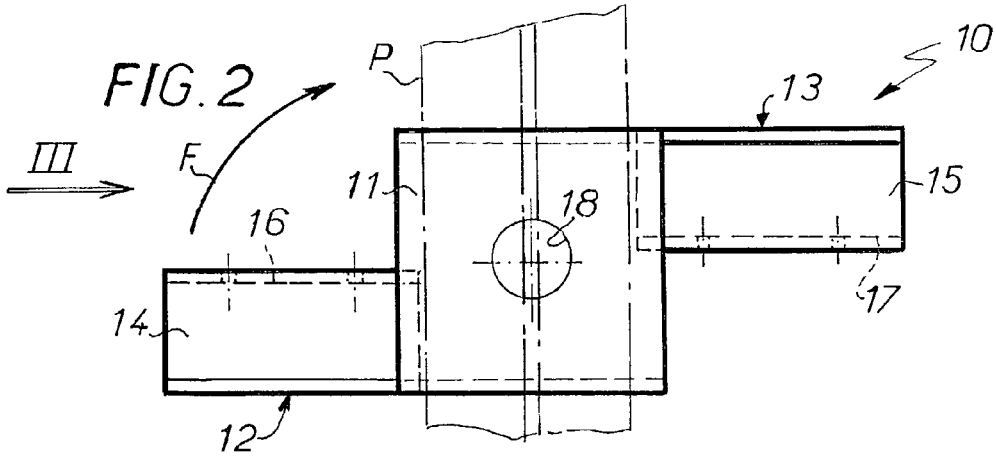
FIG. 2 is a top view of the bottom bracket from FIG. 1.
Figure 3:
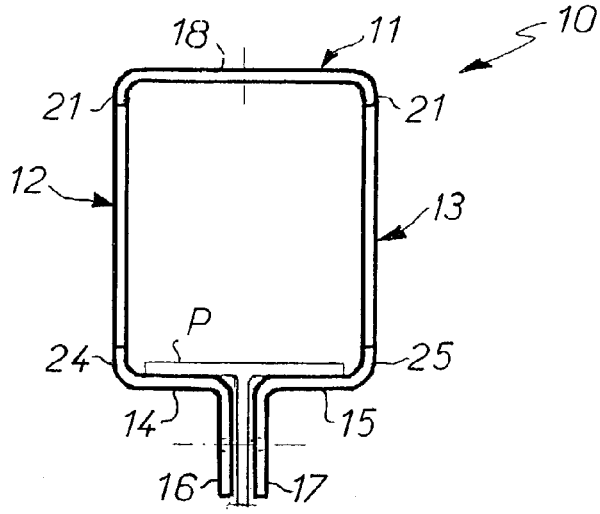
FIG. 3 is a view in the direction of the arrow III in FIG. 2.

Referring to FIGS. 1 to 3, it is seen that, in accordance with the invention, a suspender bottom bracket 10 comprises a support wall 11 which is adapted to be attached to a rod of the suspender and is extended by two flanges 12 and 13.

The two flanges 12 and 13 are in planes parallel to each other and perpendicular to the plane of the support wall 11.

Each of the flanges 12, 13 has a respective rim 14, 15 parallel to the support wall 11 and directed inward in relation to the volume encompassed by the support wall 11 and the planes of the flanges 12, 13.

Each rim 14, 15 has at its free end a respective fixing lug 16, 17 perpendicular to the support wall 11 and on the opposite side thereof relative to the rims 14 and 15.

The two fixing lugs 16 and 17 are offset in a direction parallel to the planes of the flanges 12 and 13 by a distance sufficient to permit the passage of a framework, in this instance a section P whose upper portion is T-shaped, as shown in relatively thinner line in the figures, as in the case of an I-section, for example.

According to one important feature of the invention, the flanges 12 and 13 have the overall shape of parallelograms 22, 23.

The above kind of bottom bracket 10 is simply obtained by bending a cut-out blank such as that shown in plan view in FIG. 4, which also shows bending lines 20.

It can be seen that such blanks can be cut out from strip without wasting material, which is economical.

Here, the lozenges 22 and 23 of the flanges 12 and 13 do not extend between two bending lines 20: the support wall 11 is rectangular, or even square, and the parallelogram 22 or 23 is connected to the support wall 11 by a connecting area 21 which extends said support wall 11 beyond the bending lines 20 that delimit it; in the same way, each rim 14, 15 is rectangular and each parallelogram 22, 23 is connected to the corresponding rim by a connecting area 24, 25 which extends the rim concerned.

Thus, to be more precise, the flange 12, which lies between two bending lines 20, comprises the parallelogram 22 and the two connecting areas 21 and 24; similarly, the flange 13 comprises the parallelogram 23 and the two connecting areas 21 and 25.

In the embodiment described and shown, the nonparallel sides of the parallelograms 22 and 23 are at an angle of 45° to each other.

The use of the bottom bracket 10 according to the invention follows from the above description.

After fitting the bottom bracket 10 over the upper portion of the section P, as shown in FIGS. 1 and 2, it is sufficient to pivot the bottom bracket 10 by one quarter-turn in the direction of the arrow F in FIG. 2 to bring said bottom bracket 10 into the FIG. 3 position in which the fixing lugs 16 and 17 are pressed against respective opposite sides of the web of the section P with the horizontal flange of the section P resting on the rims 14 and 15, the relative dimensions of the bottom bracket 10 and the section P being determined accordingly.

Holes 19 in the fixing lugs 16 and 17 enable them to be fixed, for example screwed, to the web of the section P.

It can be seen that, thanks to the invention, it is possible to install the suspender first and then to suspend a section P from its bottom bracket 10 afterwards.

Furthermore, the flanges 12 and 13 inclined to the horizontal, here at 45°, and directly connecting the support wall 11 to the rims 14 and 15 on which the section P rests produce a very high resistance to traction.

The bottom bracket 10 encompasses a volume that can be exploited to install a spring member for coupling the rod to the bottom bracket, said spring member minimizing or eliminating the transmission of vibrations.

The FIG. 5 partial view shows a spring member comprising an elastomer block 32 having in its upper portion a button by means of which it is clipped onto the support wall 11, which has an opening 18 in it for this purpose (see FIGS. 1 to 4).

The elastomer block 32 is molded around an insert 33 which has an internally screwthreaded central bore on the axis of a central passage formed in the block 32; a threaded rod 31 meshes with the central thread of the insert 33; the position of the bottom bracket 10 on the rod 31 can therefore be adjusted.

In the FIG. 6 variant, the insert is replaced by a cup 43 which caps the lower portion of an elastomer block 42 and against which bears a nut 44 screwed onto the threaded rod.

In FIG. 7, an elastomer block 52 in series with a coil spring 53 is used.

The invention claimed is:

1. A suspender bottom bracket for ceiling frameworks, which bottom bracket (10) comprises:

a support wall (11) which is adapted to be fastened to a rod (31) of the suspender and is extended by two flanges (12, 13) in parallel planes and each having a rim (14, 15) parallel to the support wall (11), the two rims (14, 15) being directed toward the interior of the volume encompassed by the support wall (11) and the planes of the flanges (12, 13), wherein the rims (14, 15) have at their end a fixing lug (16, 17), said fixing lugs (16, 17) being on the opposite side of the support wall (11) relative to the rims (14, 15), perpendicularly to the support wall (11), and being offset in a direction parallel to the planes of the flanges (12, 13) by a distance sufficient to provide a passage for the framework, said flanges (12, 13) that extend from the support wall (11) as far as said rims (14, 15) having the overall shape of parallelograms (22, 23), wherein each of said parallelogram-shaped flanges has two sets of opposing sides that are not perpendicular to each other.

2. A suspender bottom bracket according to claim 1, characterized in that the support wall (11) is generally rectangular and the area (21) connecting the flanges (12, 13) to the support wall (11) extends the support wall (11), said connecting area (21) being extended into said parallelogram shape (22, 23).

3. A suspender bottom bracket according to claim 2, characterized in that the rims (14, 15) are generally rectangular and the area (24, 25) connecting the flanges (12, 13) to said rims (14, 15) extends the rims (14, 15), said connecting area (24, 25) extending into said parallelogram shape (22, 23).

4. A suspender bottom bracket according to claim 3, characterized in that the non-parallel sides of the parallelograms (22, 23) are at an angle of 45° to each other.

5. A suspender bottom bracket according to claim 2, characterized in that the non-parallel sides of the parallelograms (22, 23) are at an angle of 45° to each other.

6. A suspender bottom bracket according to claim 1, characterized in that the rims (14, 15) are generally rectangular and the area (24, 25) connecting the flanges (12, 13) to said rims (14, 15) extends the rims (14, 15), said connecting area (24, 25) extending into said parallelogram shape (22, 23).

7. A suspender bottom bracket according to claim 6, characterized in that the non-parallel sides of the parallelograms (22, 23) are at an angle of 45° to each other.

8. A ceiling framework suspender including a rod coupled to a bottom bracket, characterized in that the bottom bracket is a bottom bracket according to claim 1.

9. A suspender according to claim 8, characterized in that the rod (31) is a threaded rod.

10. A suspender according to claim 9, characterized in that the rod is coupled to the bottom bracket (10) by an elastic member.

11. A suspender according to claim 10, characterized in that the elastic member comprises at least one of a coil spring (43) and an elastomer block (32, 42).

12. A suspender according to claim 10, characterized in that the elastic member comprises an elastomer block (52) and a coil spring (43) in series.

13. A suspender according to claim 8, characterized in that the rod is coupled to the bottom bracket (10) by an elastic member.

14. A suspender according to claim 13, characterized in that the elastic member comprises at least one of a coil spring (43) and an elastomer block (32, 42).

15. A suspender according to claim 13, characterized in that the elastic member comprises an elastomer block (52) and a coil spring (43) in series.

16. An assembly comprising a ceiling framework and at least one suspender, characterized in that the suspender is a suspender according to claim 8.

17. An assembly according to claim 16, characterized in that the framework comprises I-sections (P) and the fixing lugs (16, 17) of the bottom brackets (10) are fastened to the web of said sections (P).

18. A suspender bottom bracket for ceiling frameworks, which bottom bracket (10) comprises:

a support wall (11) which is adapted to be fastened to a rod (31) of the suspender and is extended by two flanges (12, 13) in parallel planes and each having a rim (14, 15) parallel to the support wall (11), the two rims (14, 15) being directed toward the interior of the volume encompassed by the support wall (11) and the planes of the flanges (12, 13), wherein the rims (14, 15) have at their end a fixing lug (16, 17), said fixing lugs (16, 17) being on the opposite side of the support wall (11) relative to the rims (14, 15), perpendicularly to the support wall (11), and being offset in a direction parallel to the planes of the flanges (12, 13) by a distance sufficient to provide a passage for the framework, said flanges (12, 13) that extend from the support wall (11) as far as said rims (14, 15) having the overall shape of parallelograms (22, 23), wherein the non-parallel sides of the parallelograms (22, 23) are at an angle of 45° to each other.

* * * * *